United States Patent [19]

Sato

[11] 4,175,957

[45] Nov. 27, 1979

[54] ELECTROPHOTOGRAPHIC PROCESS USING INSULATING DOT OVERLAYER

[75] Inventor: Eiichi Sato, Tama, Japan

[73] Assignee: Olympus Optical Company Limited, Tokyo, Japan

[21] Appl. No.: 863,167

[22] Filed: Dec. 22, 1977

[30] Foreign Application Priority Data

Jan. 14, 1977 [JP] Japan ..... 52/2360

[51] Int. Cl.[2] ..... G03G 13/24

[52] U.S. Cl. ..... 430/31; 430/68

[58] Field of Search ..... 96/1 R; 355/35 C

[56] References Cited

U.S. PATENT DOCUMENTS

| | | | |
|---|---|---|---|
| 2,917,385 | 12/1959 | Byrne | 96/1.5 R |
| 3,532,494 | 10/1970 | Bhagat | 96/1 R |
| 3,627,526 | 12/1971 | Donald | 96/1.5 R |
| 3,676,118 | 7/1972 | Mott et al. | 96/1 R X |
| 3,756,811 | 9/1973 | Gundlach | 96/1 R X |
| 3,832,170 | 8/1974 | Nagamatsu et al. | 96/1.8 X |

FOREIGN PATENT DOCUMENTS

| | | | |
|---|---|---|---|
| 44-26596 | 11/1969 | Japan | 96/1 R |
| 48-42979 | 12/1973 | Japan | 96/1.5 N |

*Primary Examiner*—Roland E. Martin, Jr.
*Attorney, Agent, or Firm*—Haseltine, Lake & Waters

[57] ABSTRACT

An electrographic process which makes use of a photosensitive screen is disclosed. The photosensitive screen is composed of an electrically conductive support, a photoconductive member coated on the electrically conductive support and a dot-, line- or mesh-shaped insulating member coated on the surface of the photoconductive member with an interface formed between the photoconductive member and the insulating member. An electric charge is trapped on the interface and an electrostatic latent image corresponding to a manuscript image is produced on the insulating member only, thereby obtaining an electrographic image having excellent resolving power.

3 Claims, 4 Drawing Figures

ELECTROPHOTOGRAPHIC PROCESS USING INSULATING DOT OVERLAYER

BACKGROUND OF THE INVENTION (1) Field of the Invention:

This invention relates to an electrographic process which makes use of a photosensitive screen.

(2) Description of the Prior Art:

As an electrographic process, an electrofax system, a xerox system, PIP (Persistent Internal Polarization) system etc. have heretofore been well known. Both the electrofax system and the xerox system make use of so-called carlson's process for the purpose of producing a picture image. For this purpose, the electrofax system employs a chargeable member composed of an electrically conductive support coated with a photoconductive layer formed of zinc oxide, while the xerox system employs a chargeable member composed of an electrically conductive support coated with a photoconductive layer formed of non-crystalline selenium. In both the electrofax system and the xerox system, the surface of the photoconductive layer is uniformly charged by a flow of corona ions and then the charged surface is illuminated by a manuscript image light. In the imagewise exposed area of the charged surface, the electric charge is discharged to produce thereon an electrostatic charge image corresponding to a manuscript image. Subsequently, the electrostatic charge image is developed by charged color particles to render the electrostatic charge image visible. In the electrofax system, the visible image is fixed, as is, to provide an electrographic image. In the xerox system, the visible image is transferred to another support such as a record sheet etc. and then fixed to provide an electrographic image.

The PIP system, particularly its modified NP system makes use of a photosensitive body mainly composed of an electrically conductive support, a photoconductive film and an insulating film. The photosensitive body is uniformly charged at the first time and then is illuminated by a manuscript image light and at the same time charged again. Subsequently, the overall surface of the charged photosensitive body is exposed to light to produce, on the insulating film, an electrostatic charge image corresponding to a manuscript image. The electrostatic charge image is developed by charged color particles to render the electrostatic charge image visible which is then transferred to another support such as a record sheet etc. and then fixed to provide an electrographic image.

In all of the above described conventional electrographic processes, the electrostatic charge image is produced on the photoconductive layer or the insulating film uniformly superimposed one upon the other, so that the resolving power of the final copy becomes degraded.

An electrographic process comprising producing, on a photosensitive screen having a number of fine meshes, a first electrostatic latent image corresponding to a manuscript image and modulating a flow of corona ions by the first electrostatic latent image to produce on, a dielectric coated record layer, a second electrostatic latent image, has also been proposed. Such conventional electrographic process is capable of producing a picture image through the first electrostatic latent image produced on the photosensitive screen having a number of fine meshes and hence it is possible to obtain a final copy having an excellent resolving power. This conventional process, however, has the drawback that it is difficult to manufacture the photosensitive screen.

SUMMARY OF THE INVENTION

An object of the invention, therefore, is to provide an electrographic process which can eliminate the drawbacks which have been encountered with the above described prior art techniques, that is, which can form copies of a picture image having excellent resolving power by means of a photosensitive screen which can be manufactured in a significantly easy manner.

A feature of the invention is the provision of an electrographic process comprising using a photosensitive screen composed of an electrically conductive support, a photoconductive member coated on the electrically conductive support and a dot-, line- or mesh-shaped insulating member coated on the surface of the photoconductive member, uniformly charging the photosensitive screen and at the same time illuminating the photosensitive screen by a light image, uniformly exposing the photosensitive screen to light and producing, on the insulating member only, an electrostatic latent image corresponding to the light image, and developing and fixing the electrostatic latent image into a visible picture image.

BRIEF DESCRIPTION OF THE SEVERAL VIEWS OF THE DRAWINGS

The invention will now be described in greater detail with reference to the accompanying drawings, wherein.

DESCRIPTION OF THE PREFERRED EMBODIMENTS

Figure 1:
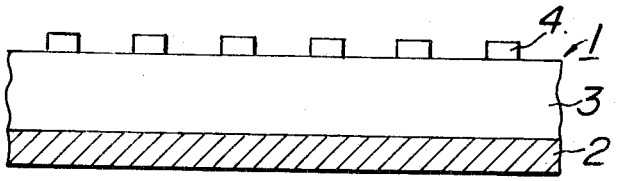
FIG. 1 is a cross-sectional view of one embodiment of a photosensitive screen for practicing an electrographic process according to the invention.

In FIG. 1 is shown one embodiment of a photosensitive screen for practicing an electrographic process according to the invention. In the present embodiment, a photosensitive screen 1 is composed of an electrically conductive support 2, a photoconductive member 3 coated on the electrically conductive support 2 and a dot-, line- or mesh-shaped insulating member 4 coated on the surface of the photoconductive member 3. The insulating member 4 projects of the surface of the photoconductive member 3 with an interface formed between the photoconductive member 3 and the insulating member 4. The electrically conductive support 2 may be formed of a metal plate, metal drum or sheet of paper or textile cloth having an electrically conductive surface. The photoconductive member 3 may be formed of Se, PbO, S and an alloy, intermetallic compound with an alloying metal selected from the group consisting of Se, Te, Sb and Bi and vapor deposited on the electrically conductive support 2; or of ZnO, CdS and $TiO_2$ and coated on the electrically conductive support 2 by spattering; or of ZnO, CdS, $TiO_2$ and PbO dissolved in an organic insulating binder and coated on the electrically support 2 by spraying; or of a composite photosensitive layer composed of Se, Te and an organic photosensitive body etc. The insulating member 4 may be formed by spraying or printing through masks, polyethylene, polypropylene, polyvinyl chloride, polyurethane, polyvinyl acetate, acryl resin, polycarbonate, silicone resin, fluorine resin, epoxy resin etc.

Figure 2:
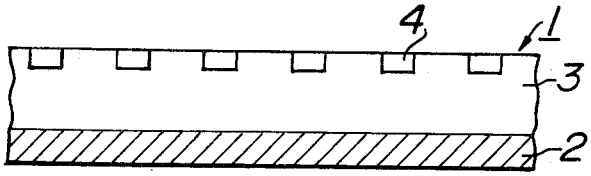
FIG. 2 is a cross-sectional view of another embodiment of a photosensitive screen for practicing an electrographic process according to the invention.

In FIG. 2 is shown another embodiment of a photosensitive screen for practicing an electrographic process according to the invention. In the present embodiment, a photosensitive screen 1 is composed of an electrically conductive support 2, a photoconductive member 3 coated on the electrically conductive support 2 and a dot-, line- or mesh-shaped insulating member 4 embedded in and partly exposed at the surface of the photoconductive member 3. The electrically, conductive support 2, photoconductive member 3 and insulating member 4 of the photosensitive screen 1 shown in FIG. 2 are formed of substances which are the same as those described with reference to FIG. 1, respectively.

A step of producing, on the photosensitive screen shown in FIG. 1, a picture image by an electrographic process according to the invention will now be described. The photoconductive member 3 of the photosensitive screen shown in FIG. 1 is composed of a P type semiconductor formed of Se for the sake of convenience.

Figure 3:
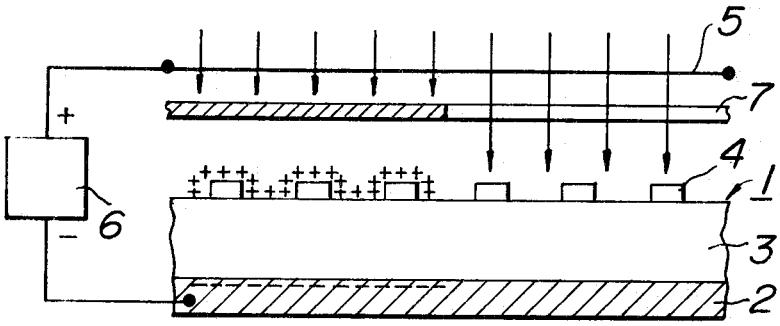
FIG. 3 is a diagrammatic view illustrating a step of producing, on the photosensitive screen shown in FIG. 1, an electrostatic latent image by an electrographic process according to the invention.

In FIG. 3 is diagrammatically illustrated a step of uniformly charging the photosensitive screen 1 and at the same time illuminating it by a light image to produce, on the photosensitive screen 1, an electrostatic latent image corresponding to a manuscript image. As shown in FIG. 3, a corona discharge wire 5 is arranged in opposition to the insulating member 4 and a corona voltage source 6 is connected between the corona discharge wire 5 and the electrically conductive support 2 of the photosensitive screen 1. Between the corona discharge wire 5 and the photosensitive screen 1 is arranged a manuscript 7. The corona discharge wire 5 provides a source of corona ions, and the electric field produced between the corona discharge wire 5 and the electrically conductive support 2 directs a flow of corona ions having a positive polarity toward the photosensitive screen 1. At the same time, the photosensitive screen 1 is illuminated by a light image of the manuscript 7. In the imagewise dark area of the photosensitive screen 1, the photoconductive member 3 is insulating and hence has a high resistance and the corona ions, after building up a samll potential on the surface of the photosensitive screen 1, pass through the openings in the photosensitive screen 1 to charge both the insulating member 4 and the underlying photoconductive member 3 to a high potential. In the imagewise exposed area of the photosensitive screen 1, the photoconductive member 3 is conducting and hence has a low resistance, and the corona ions which come into proximity thereto are attracted to the photoconductive member 3 and pass directly to the corona voltage source 6. This modulation of control of the flow of corona ions from the corona discharge wire 5 to the photosensitive screen 1 operates to produce, on the photosensitive screen 6, an electrostatic latent image corresponding to the image of the manuscript 7.

Figure 4:
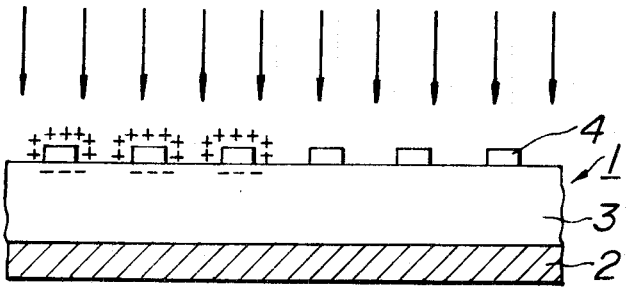
FIG. 4 is a diagrammatic view illustrating a step of uniformly exposing the photosensitive screen shown in FIG. 1 to light by an electrographic process according to the invention.

In FIG. 4 is diagrammatically illustrated a step of uniformly exposing to light and the overall surface of the photosensitive screen 1 on which the electrostatic latent image has been produced as described above with reference to FIG. 3. In this way, if the overall surface of the photosensitive screen 1 is exposed to light, the electric charge charged on the surface of the photoconductive member 3 in the imagewise dark area of the photosensitive screen 1 disappears. The positive electric charge on the surface of the insulating member 4 causes a negative electric charge to be trapped on the interface between the photoconductive member 3 and the insulating member 4. As a result, the electrostatic latent image corresponding to the manuscript image is produced on the insulating member 4 only.

The electrostatic latent image produced on the photosensitive screen 1 in the manner as described above is then developed by means of charged color particles into a visible image which is then transferred onto another support such as a record sheet etc. and finally the visible image is fixed, generally by fusing. As a result, it is possible to obtain an electrographic image having an excellent resolving power. That is, the use of a proper size of the dot-, line- or mesh-shaped insulating member 4 arranged on the photoconductive member 3 ensures excellent reproduction of a picture image and provides the important advantage that a manuscript composed of fine lettering, for example, can be reproduced without deforming the latter. In addition, since the photoconductive member 3 is substantially covered with the insulating member 4, the photosensitive member 3 is not deteriorated and hence the photosensitive screen 1 can repeatedly be used for a long time. The electrostatic latent image corresponding to the manuscript image is produced on the insulating member 4 of the photosensitive screen 1, so that it is not always necessary to make the resistance of the photoconductive member 3 high. As a result, the photoconductive member 3 may be formed of a photosensitive material having a high sensitivity.

If the electrographic process according to the invention is applied to a conventional electrographic process comprising transferring the electrostatic latent image produced on the photosensitive screen 1 onto an electrostatic record sheet etc. in the same manner as T.E.S.I. (Transfer of Electro-Static Image) system, producing, on the electrostatic record sheet, a second electrostatic latent image, and developing the second electrostatic latent image into a visible image by charged color particles, it is possible to improve the picture quality of copies to be obtained by the above described conventional electrographic image. In addition, the electrographic process according to the invention can make the life of the photosensitive screen several times to several tens times longer than that of a photosensitive screen used for a combination of the above described carlson's process and T.E.S.I. system.

What is claimed is:

1. An electrographic process comprising using a photosensitive screen consisting of an electrically conductive support, a photoconductive member coated on the electrically conductive support and a dot-, line- or mesh-shaped insulating member coated on the surface of the photoconductive member, said photoconductive member being exposed to the ambient atmosphere through said insulating member, uniformly charging said photosensitive screen and at the same time illuminating said photosensitive screen by a light image, and uniformly exposing said photosensitive screen to light so as to produce, on said insulating member only, an electrostatic latent image corresponding to said light image.

2. The electrographic process according to claim 1, wherein said dot-, line- or mesh-shaped insulating member project at the surface of said photoconductive member.

3. The electrographic process according to claim 1, wherein said dot-, line- or mesh-shaped insulating member is embedded in and partly exposed at the surface of said photoconductive member.

* * * * *